United States Patent [19]

Ray

[11] 4,067,446

[45] Jan. 10, 1978

[54] CABLE STAY CRANE

[76] Inventor: Louis F. Ray, P.O. Box 14702, Baton Rouge, La. 70808

[21] Appl. No.: 661,063

[22] Filed: Feb. 24, 1976

[51] Int. Cl.[2] ..... B66C 23/72

[52] U.S. Cl. ..... 212/48; 212/12; 212/32; 212/46 A; 212/56; 340/267 C

[58] Field of Search ..... 212/46, 12, 18, 39, 212/48, 56, 49, 63, 68, 69, 32, 66, 67; 340/267 C; 104/94, 166, 167; 105/29, 155

[56] References Cited

U.S. PATENT DOCUMENTS

| | | | |
|---|---|---|---|
| 859,031 | 7/1907 | Abel | 212/48 |
| 1,343,630 | 6/1920 | Locarni | 212/49 |
| 2,772,411 | 11/1956 | Cooper | 340/267 C |
| 2,796,178 | 6/1957 | Praschak | 212/63 |
| 3,190,475 | 6/1965 | Fischer | 212/69 |
| 3,402,824 | 9/1968 | Zweifel | 212/56 |
| 3,642,148 | 2/1972 | Durand | 212/48 |
| 3,722,705 | 3/1973 | Gould | 212/49 |
| 3,957,161 | 5/1976 | Tax | 212/69 |

FOREIGN PATENT DOCUMENTS

| | | | |
|---|---|---|---|
| 1,268,339 | 5/1968 | Germany | 212/46 A |
| 1,949,456 | 4/1971 | Germany | 212/48 |
| 169,627 | 12/1951 | Germany | 212/48 |
| 496,772 | 8/1954 | Italy | 212/48 |
| 42,917 | 8/1917 | Sweden | 212/49 |

*Primary Examiner*—Lawrence J. Oresky

*Attorney, Agent, or Firm*—Sughrue, Rothwell, Mion, Zinn and Macpeak

[57] ABSTRACT

A crane for lifting of objects has a base and a substantially vertical column assembly extending from the base. A cross truss is mounted on the column, and cables are pivotally secured to the truss and fixed to the top of the column. Movably mounted on one side of the column on the truss is a lift assembly which includes a hoist cable and winding means, and a movable counterweight assembly is operatively disposed on the truss on the opposite side of the column. Tilt sensors on the column result in movement of the counterweight assembly to compensate for weight applied at the hoist cable, and thus balance the truss.

The crane is either land mounted, or attached to a buoyant vessel.

The truss has a track and rollers for hanger arms of the counterweight and lift assembly.

3 Claims, 15 Drawing Figures

FIG. 10
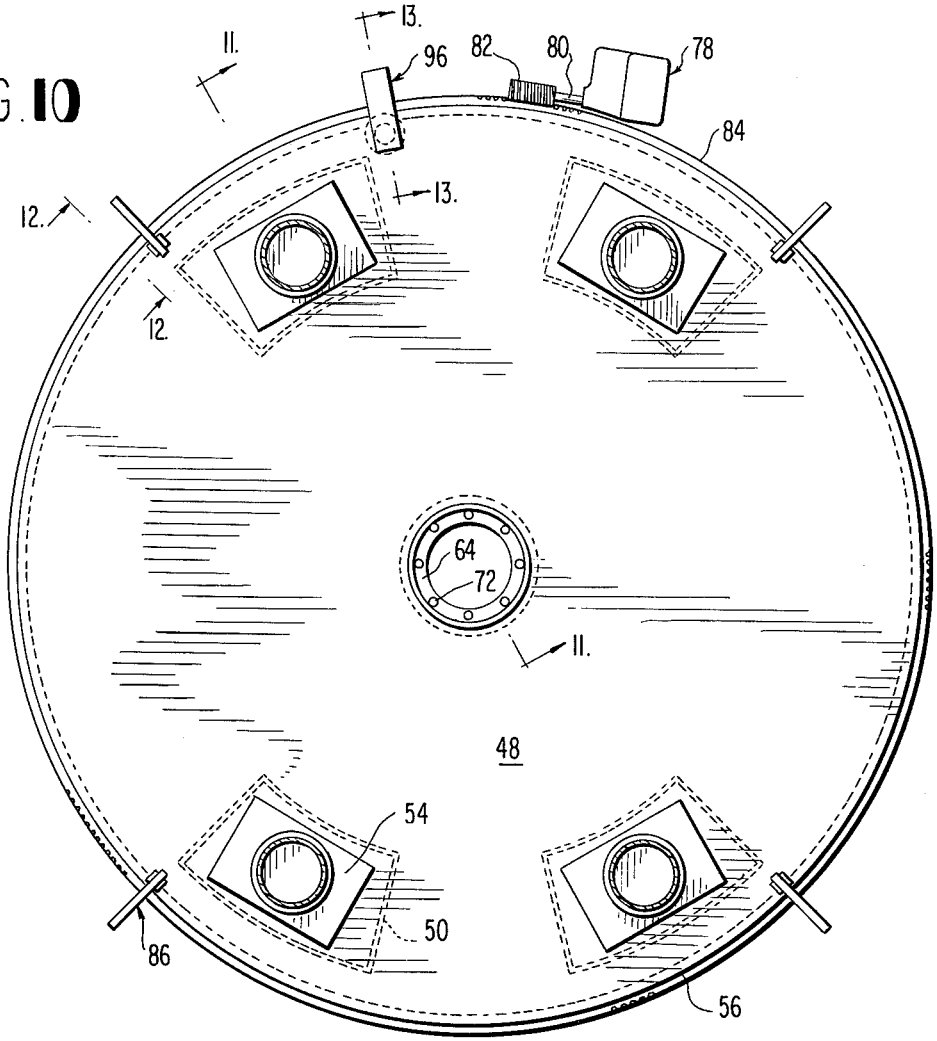
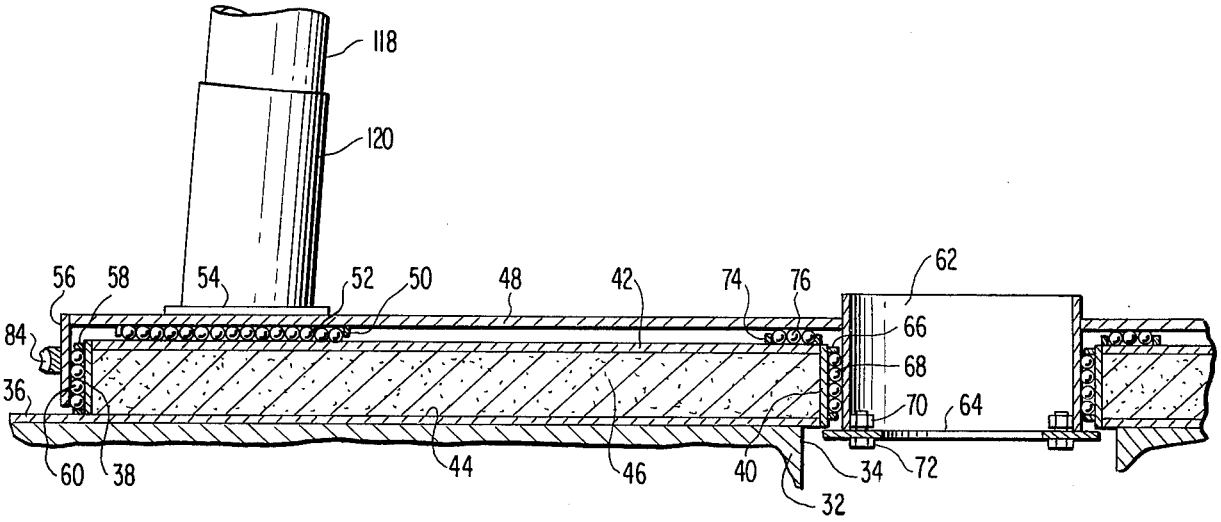
FIG. 11

CABLE STAY CRANE

BACKGROUND OF THE INVENTION

1. Field of the Invention

This invention relates to a balance principle crane adapted to position a counterweight on a horizontal truss in such location as to maintain stability as a load is applied at a remote location on the truss. The principle hereof is applicable to both land and water based cranes.

2. Statement of the Prior Art

Existing apparatus and that shown in patented art pertaining to cranes have proposed various counterweight means. None of these however, insofar as known, pertain to equalization of load at the lift gantry or boom.

SUMMARY OF THE INVENTION

A basic principle in avoidance of tilting of gantry or boom type cranes as supplied by this invention is that of incorporation of the counterweight adapted to exert an equal and opposite reaction to the load imposed on the device in performing its lift function. Essentially, the invention comprehends an elongated truss or boom, supported centrally, and having movable hoist assembly which incorporates a lift mechanism on one side of the support, and a movable counterweight on the opposite side of the support. The counterweight is moved horizontally on the truss, either in a direction toward the support or to a remote position as a function of the weight imposed at the lift location.

The crane of this invention may be land mounted, or mounted on land or water-borne vehicles. It may be rotatable or fixed on its base, whereby a load may be effectively transferred from place to place within its area of movement or along its axis.

The machine is maintained in balanced condition at all times whether in loaded or unloaded status. This is important in all environments of use, but is particularly critical where a water-borne situation is contemplated. Where a crane is mounted on a barge, a tendency to tilt or sway may be disastrous.

The present embodiment of the invention involves the incorporation of a truss span principle in the construction of the boom or gantry. The crane structure involves a vertical tower in the form of a series of columns, and a horizontal truss secured on cross braces between the columns. The columns are joined together at a top section, and a plurality of cables, chains or tension members are fixedly secured to the top section. These cables extend outwardly and are pivot mounted at longitudinally spaced positions along the truss. In this arrangement, the overhead cables absorb an optimum portion of the transmitted load, and avoid bending moments in the components. The tower and truss, or beam are in compression, and the cable is under tension, thereby eliminating bending or overturning moments. In turn, this results in a substantial increase in the capacity of the device as compared to conventional cranes.

Additional objects and advantages of the invention will become apparent to those skilled in the art from a consideration of the following specification when read in conjunction with the annexed drawings:

BRIEF DESCRIPTION OF THE DRAWINGS

FIG. 10 is a top view of the support base for the unit, the support column being shown in sections;

FIG. 11 is an enlarged sectional view on line 11—11 of FIG. 10, looking in the direction of the arrows;

DESCRIPTION OF THE PREFERRED EMBODIMENTS

Figure 1:
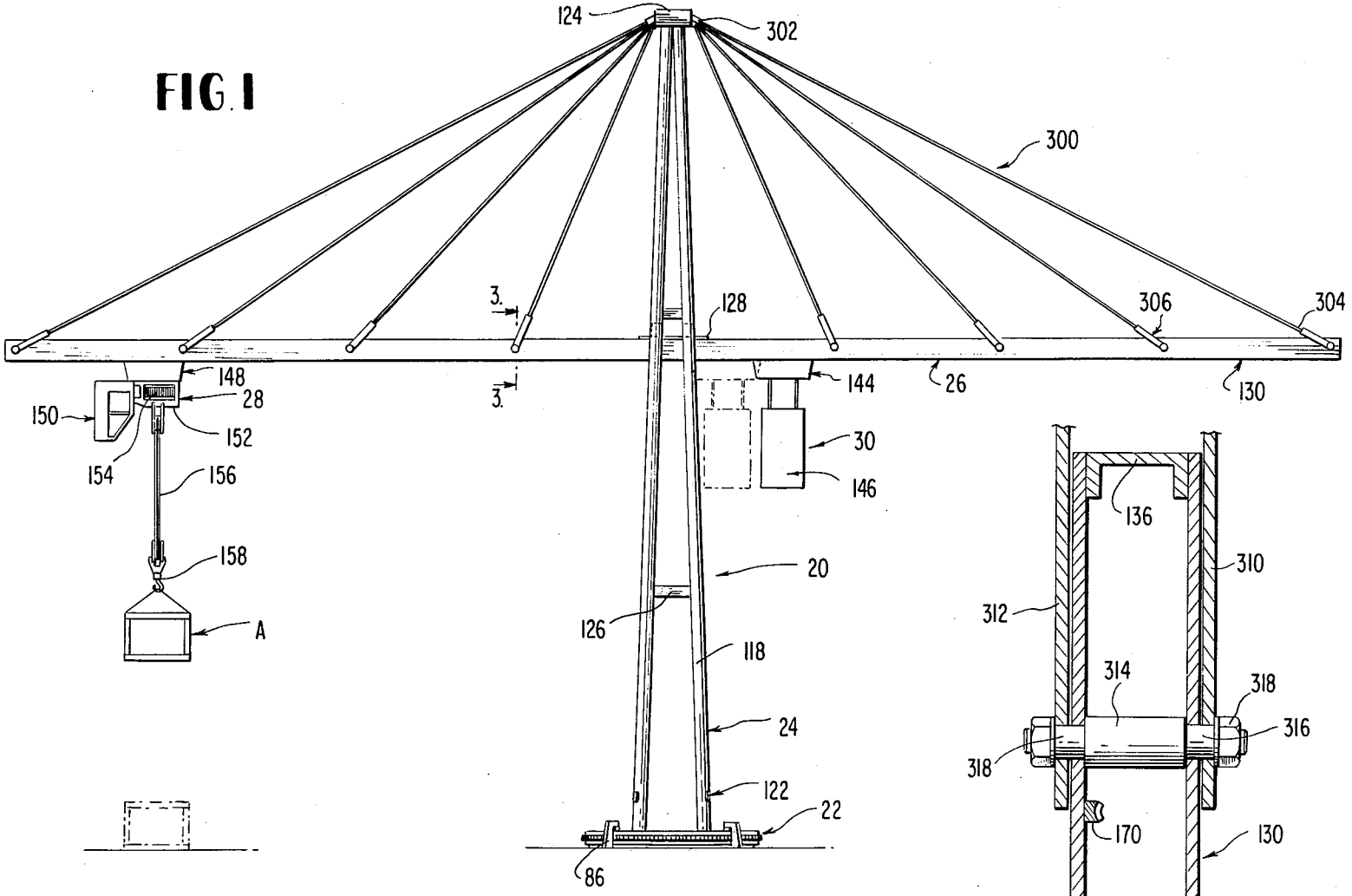
FIG. 1 is a side elevational view of a cable stay crane constructed and assembled in accordance with the teachings of this invention.

Referring to the drawings in more detail, a cable stay crane according to this invention is shown in assembled condition in FIG. 1 and there identified generally by reference character 20. The cable stay crane includes a base assembly 22, a tower assembly 24, and a boom or truss assembly 26. Movably disposed on the truss assembly 26 are a lift assembly 28 and a counterweight assembly 30.

FIGS. 10 through 13 best illustrate the base assembly 22. In a permanent mount situation, the base rests on a support 32 having a central opening or depression 34, and includes an annular or base plate 36. Inner and outer vertical walls 38 and 40 are spanned by a top annular plate 42. The base plate 36, top plate 42 and walls 38 and 40 define a chamber 44 which is filled with heavy material 46 such as an aggregate. A column plate 48 overlies and extends outwardly of the top plate 42. A series of depending bearing retention brackets 50 depend from the top plate, and bearings 52 are disposed therein. These preferably underlie column mounting plates 54. A peripheral vertical skirt 56 depends from the outer edge of the column plate. A bearing retainer bracket 58 extends toward the skirt 56 from the vertical wall 38, and bearings 60 are disposed therein. A ring-like core member 62 has an annular disc 64 fixedly secured within the openings 34, the disc being of a dimension such that the core is retained in place, and the inner vertical walls having a bearing bracket 66 - bearings 68 being located therein. The mounting of the disc 64 to the core member 62 involves the welding of nuts 70 to the core, bolts 72 extending through openings in the disc and into threaded engagement with the nuts 70. For stability, a bearing bracket 74 extends from the plate 42, and bearings 76 are disposed therein between the top plates 42 and the column plate 48.

Figure 2:
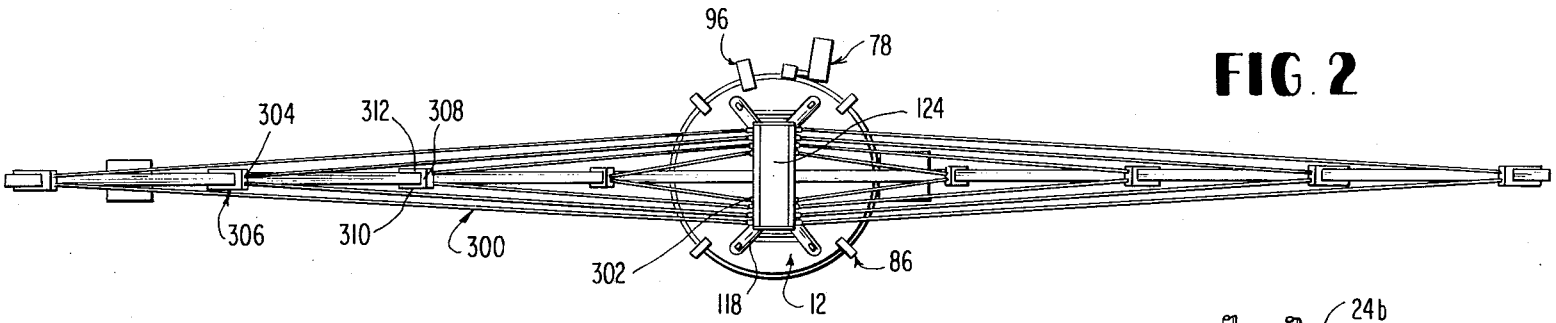
FIG. 2 is a top plan view of the crane.

In FIG. 2, a motor 78 is shown, having an output shaft 80 with a gear 82. The gear 82 meshes with a ring gear 84 fixedly secured to the skirt 56. The motor is reversible, and thus, the column plate and skirt are rotatable relative to the base and top plates.

Figure 12:
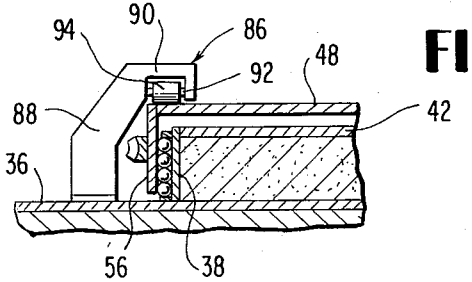
FIG. 12 is an enlarged cross-sectional view showing tip prevent means, on line 12—12 of FIG. 10, looking in the direction of the arrows.
Figure 13:
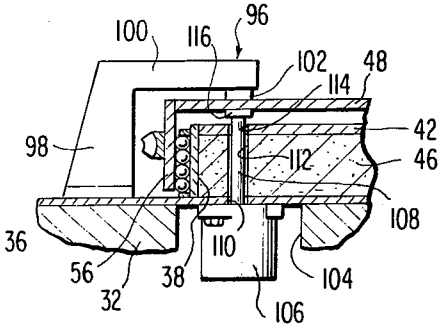
FIG. 13 is a sectional view on enlarged scale of the rotation brake incorporated in the base, taken on line 13—13 of FIG. 10, looking in the direction of the arrows.

In FIG. 12, details of one of a series of tip prevent members 86 are shown. Each comprises a leg member 88 fixedly secured to the base plate 36, and having a horizontal arm 90 which extends over the column plate 48. The arm carries an axle 92 on which a roller 94 contacting the plate is rotatably mounted. Locking of the base assembly at a selected position is accomplished with a lock brake assembly 96 (FIG. 13). A bracket 98 projects from the base plate 36 and has a radially inwardly extended arm 100. The arm 100 projects over the column plate 48 and carries an upper brake pad 102. Disposed in an opening 104 in the support 32 is a hydraulic cylinder 106 having an extendible and retractable rod 108. The cylinder is secured to the base plate 36, and the rod extended through an aperture 110 formed therein and through aligned openings 112, 114 in the material 46 and top plate 42. At its upper extremity, the rod has a second brake pad 116 which is vertically aligned with the pad 102. Thus, upon extension of the rod 108, the column plate 48 is clamped between the pads 102 and 116 thereby preventing further rotation of the column plate.

The tower assembly 24 extends vertically from the base, and comprises a series of tubular column members 118 mounted substantially vertical in sleeve 120 fixedly secured to the mounting plates 54. Each of the columns has incorporated therein at a location adjacent the base a strain gauge 122 of conventional design and operation, or other tilt sensing mechanism, the function of which is to sense any tilt moment of the column. Any such tilt moment which is sensed is transmitted through means not shown to the operator. The columns, here four in number, converge at their upper ends, and are thereat connected by a spanning top section member 124. At periodic locations the columns are provided with horizontal brace members 126, and a central, reinforced cross-plate 128 is mounted at an intermediate location thereon.

Figure 3:
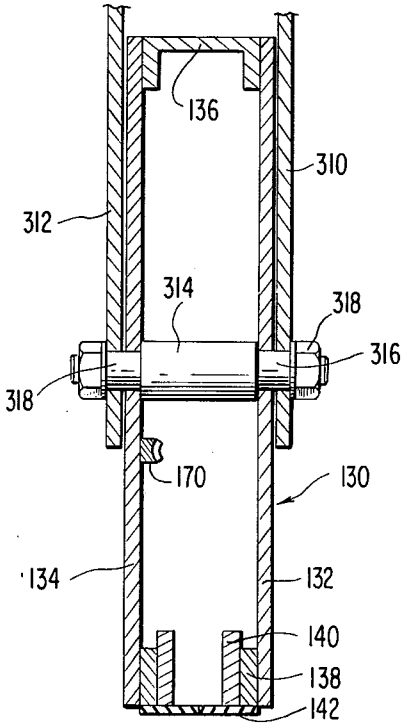
FIG. 3 is an enlarged vertical cross-section through the boom or truss, taken on line 3—3 of FIG. 1, looking in the direction of the arrows.
Figure 5:
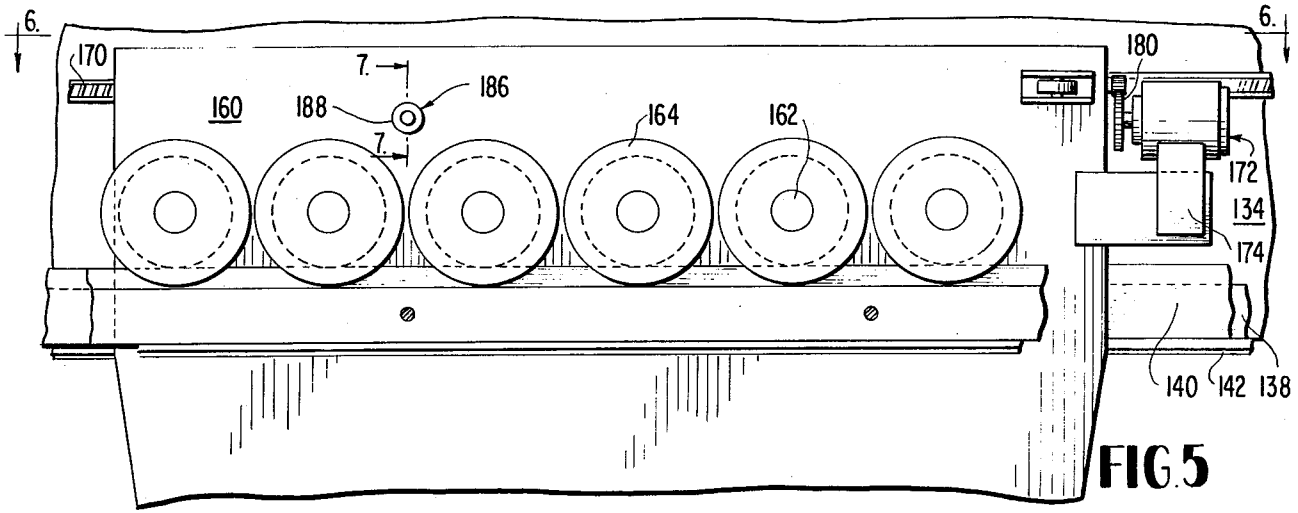
FIG. 5 is a side view sectional on line 5—5 of FIG. 4, foreshortened, of a section of the truss showing a trolley for the counterweight or lift mechanisms.
Figure 6:
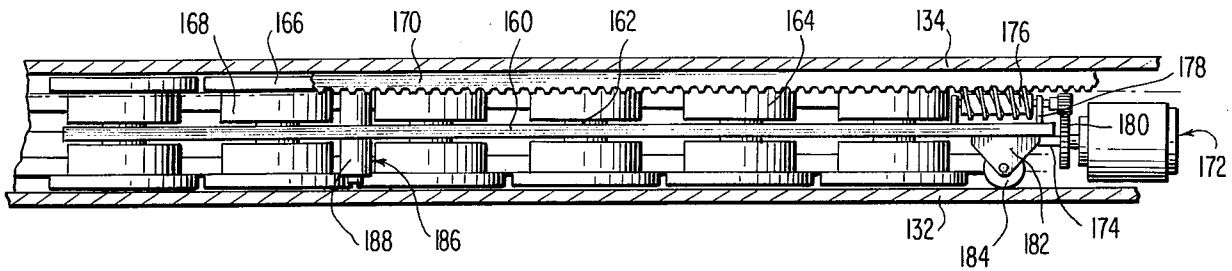
FIG. 6 is a longitudinal cross-section on line 6—6 of FIG. 5, looking in the direction of the arrows.

The cross-plate 128 has connected thereto the boom or truss assembly 26. The details of the truss assembly of the first embodiment of the invention are best shown in FIGS. 3 through 7. The truss assembly includes an elongated, horizontally disposed truss member 130 comprising a pair of spaced apart, confronting side walls 132, 134. A channel form top wall 136 secures the side walls to one another in laterally spaced relation, and a base track for each wall comprises an outer plate 138 and an inner plate 140 of greater height. As seen in FIGS. 3 and 5, the two pairs of base tracks are spaced apart, and a resilient skirt 142 of rubber or the like extends from each as a dirt seal.

The counterweight assembly 30 includes a trolley 144 which carries a weight 146. The weight may comprise any heavy item, such as a liquid filled vessel.

The lift assembly 28 also includes a trolley 148 from which is suspended an operator's cab 150 and a bracket 152. The bracket 152 carries a winch 154. A vertically movable hoist cable 156 is suspended, through appropriate blocks, from the winch, and has load connection means, such as a hook 158 at its lower end. As shown in FIG. 1, this is engaged in use with the article A to be lifted.

Both the trolley 144 and the trolley 148 are of the same construction and operation, and a description of one applies also to the other. The trolleys include a vertical hanger arm 160 which extends into the truss through the seal 142 and between the base tracks. The hanger arm has a series of cross-axles 162. Rollers 164 are rotatably mounted on the axles, and have outer sections 166 which ride on the outer plates 138 and inner sections 168 which contact the inner plates 140. Mounted on the wall 134 of the truss, and extending substantially the full length thereof is a rack gear 170. A motor 172 is mounted on the end of the hanger arm by a bracket 174. A worm gear 176 is mounted between the arm 178 on the side of the hanger arm adjacent the rack gear, and the worm gear meshes thereto. A gear train 180 operatively connects the motor to the worm gear.

On the side of the hanger arm opposite the worm gear a housing 182 is provided for a stabilizing roller 184. The roller aids in maintaining the worm gear in mesh with the rack 170. As will appear from the foregoing, actuation of the motor 172, which is of course reversible, turns the gear 176 and propels the trolley along the truss in either selected direction.

Figure 7:
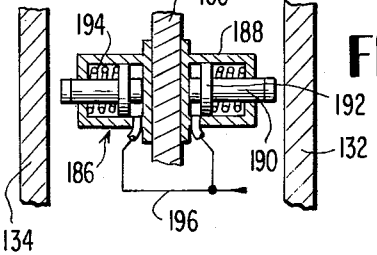
FIG. 7 is a further enlarged sectional view showing details of the trolley safety brake of FIG. 4.

A lock mechanism 186 for temporary stopping of the trolley at a selected location is best shown in FIG. 7. The lock mechanism comprises a pair of housings 188 with shafts 190 mounted therein. The shafts have collars 192 which are normally biased inwardly by springs 194. However, upon actuation from a hydraulic or electrical control 196 (not shown in detail) the shafts are extended outwardly into contact with the walls 132, 134.

Figure 9:
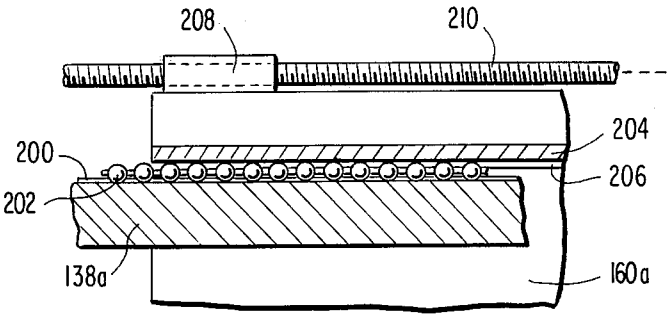
FIG. 9 is a sectional view on line 9—9 of FIG. 8, looking in the direction of the arrows.
Figure 4:
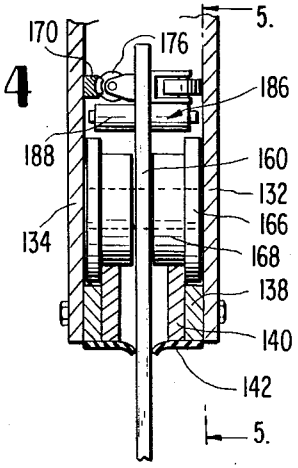
FIG. 4 is a sectional view showing details taken on line 4—4 of FIG. 5.
Figure 8:
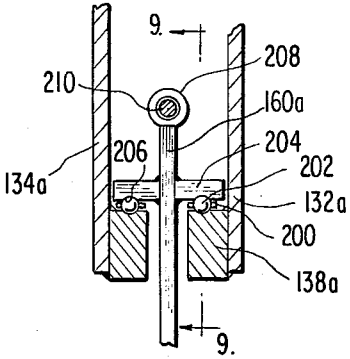
FIG. 8 is a sectional view showing a modified form of trolley drive.

In a modification of the track and conveyance means, shown in FIGS. 8 and 9, the truss side walls are identified by reference numerals **132*a* and 134*a*. Track members 138*a* are fixedly secured to each, the track members having slots 200 for bearings 202. The hanger arm 160*a* has horizontal side plates 204 projecting from each side thereof, the side plates also being grooved at 206 for the bearings 202. At least one internally threaded sleeve 208 is provided on the top of the hanger arm, and an externally threaded, elongated rod 210 is engaged in the sleeves. The rod extends the full length of the truss, and is engaged as shown diagramatically in FIG. 9 with a motor 212**. Rotation of the rod via the motor results in movement of the trolley in a selected direction.

In FIGS. 1, 2 and 3, the cable stay means for the truss are best shown. These comprise a series of cables 300 each having an upper end 302 fixedly secured to the top section 124 of the tower by conventional cable anchor means. The lower ends 304 are secured to clevises 306. Each of the clevises comprise a bight portion 308 and arms 310, 312 spaced apart a sufficient distance to fit about the truss. For each clevise, an axle 314 is provided, the axles having reduced threaded ends 316, 318 which extend through holes formed therefor in the walls 132, 134 and arms 310, 312. Nuts 318 maintain the arms on the axles. It will be observed therefore that downward forces on the truss at any given point are transmitted through the cable and distributed throughout the extent thereof.

In operation, the operator in the control cab 150 is provided with manual and/or automated controls for the rotation of the tower, for positioning and actuating of the lift, and for positioning of the counterweight. When a load is to be engaged, the operator suitably orients the lift over the load, by rotation of the tower and horizontal movement of the lift. The hook 158 is then engaged with the load A and lift force is applied. Any tendency of the tower to tilt or sway is sensed by the strain gauges, pendulum or other tilt sensing device. Through suitable signal means this is transmitted to the operator, and the counterweight is moved outwardly on the boom to compensate for the tilt moment. In a basic adaptation, the controls may be manual, but more sophisticated development would provide for automatic compensation.

Figure 14:
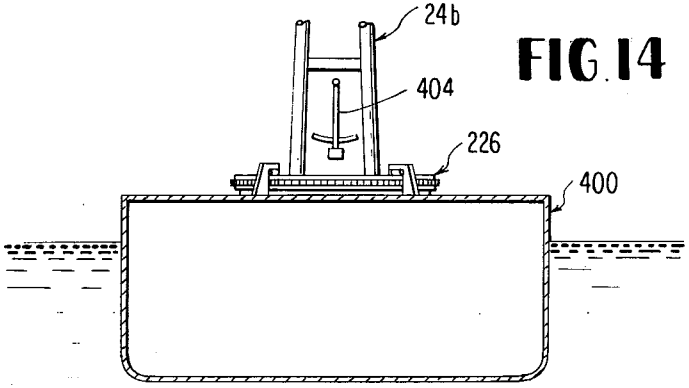
FIG. 14 shows the device as mounted on buoyant support means such as a barge.
Figure 15:
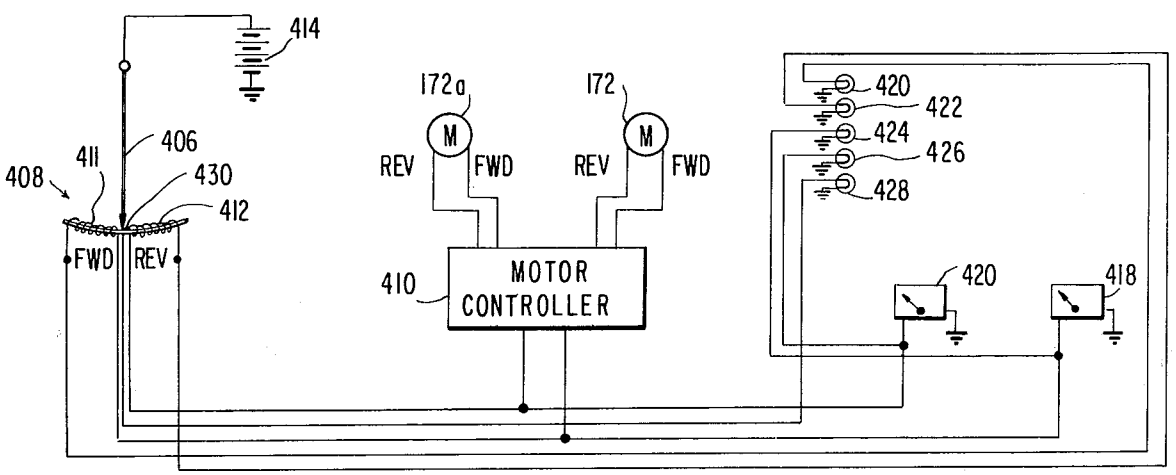
FIG. 15 is a schematic diagram of the tilt sensing and trolley actuating means.

FIGS. 14 and 15 show a modification of significance wherein the unit is mounted on a horizontal platform such as a barge 400. There, the base assembly **22*b* supports a tower 24*b* on the top deck 402 of the barge. Mounted on the tower adjacent the base is a pendulum 404**. Of course, as the platform tilts the pendulum will maintain its vertical position.

Suitably fixed to the pendulum 404 is an electrical contact 406 which moves with the pendulum and electrically engages a wire wound resistor 408 which is connected through a motor controller 410 to the reverse (REV) and forward (FWD) terminals of the counterweight motor 172. The motor controller is also connected to the reverse and forward terminals of the load motor **172*a***.

The resistor 408 has a forward winding 411 and a reverse winding 412. When the platform tilts in one direction, the electrical contact 406 will then electrically engage either the forward or reverse resistor winding 411 or 412 as is needed to drive the counterweight motor 172 in the opposite direction to drive the counterweight to a position wherein the platform is maintained in a horizontal position. Electrical contact 406 is connected to a low voltage power supply such as the battery 414. The motor controller 410 is conventional and contains low voltage stepping relays for converting the low battery voltage to high voltage necessary for starting the motor. The tilt sensing function performed by the pendulum could also be performed by a single axis rate gyro.

The position of the electrical contact 406 on the forward and reverse windings 411 and 412, respectively, of course is an indication of the degree of platform tilt, and this degree of tilt is indicated on the voltmeters 418 and 420, respectively, which are electrically connected to the forward and reverse windings 411 and 412. Tilt indicator lamps 420, 422, 424, 426 and 428 are also electrically connected to various points on the resistor 408 to give an additional visual indication of the degree of tilt. For example, lamp 420 may be red and is connected to the left end of the forward resistor winding 411; therefore, as the contact 406 moves to the left indicating an increasing degree of forward tilt, a greater battery voltage is applied to light the red lamp 420 as an indication of a danger condition for forward tilt. Similarly, lamp 422 is suitably connected to the righthand side of the reverse resistor winding 412, to indicate the condition of dangerous reverse tilt. Lamps 424 and 426 may be yellow, for example, and indicate generally forward and reverse tilt, respectively. Lamp 428 is connected to the center or neutral point of the resistor 408 and is illuminated when the platform is in the horizontal position; lamp 428 may be green, for example.

I claim:

1. A hoist apparatus comprising:

a base;

a substantially vertical column secured to the base, said column having a top section;

an elongated substantially horizontal truss assembly secured to the vertical column at a location between the base and the top section;

a series of cables, each having a column end and a truss end, the column ends being anchored to the top section, and the truss ends being pivotally connected to the truss at spaced locations, said locations being positioned at intervals from first locations adjacent the column to outer locations remote from the column;

a lift assembly horizontally movably mounted on one side of the truss assembly, said assembly including a vertically movable hoist cable and means for raising and lowering the hoist cable;

a counterweight assembly movably mounted on the other side of the truss assembly, said counterweight assembly including a suspended weight and means for horizontal movement along the truss in either direction;

sensing means on said column to detect a tendency of the column to tip from its substantially vertical orientation as a result of the hoising of the load on the hoist cable; and means interconnecting the sensing means and the means for horizontal movement of the counterweight assembly, whereby the counterweight assembly is positioned to stabilize and balance the apparatus;

the truss assembly comprising a pair of side walls, a top wall, and a base track; and the lift assembly and the counterweight assembly each including a hanger arm disposed between the side walls and having roller means engaged on the base track; wherein the hanger arm has a series of cross axles extending therethrough;

rollers on said cross axle;

the base track having a track secured to each side wall, and the rollers bearing on the tracks;

a continuous rack gear on one of said side walls;

a worm gear on the hanger arm; and a motor driving said worm gear.

2. A hoist apparatus comprising:

a base;

a substantially vertical column secured to the base, said column having a top section;

an elongated substantially horizontal truss assembly secured to the vertical column at a location between the base and the top section;

a series of cables, each having a column end and a truss end, the column ends being anchored to the top section, and the truss ends being pivotally connected to the truss at spaced locations, said locations being positioned at intervals from first locations adjacent the column to outer locations remote from the column;

a lift assembly horizontally movably mounted on one side of the truss assembly, said assembly including a vertically movable hoist cable and means for raising and lowering the hoist cable;

a counterweight assembly movably mounted on the other side of the truss assembly, said counterweight assembly including a suspended weight and means for horizontal movement along the truss in either direction;

sensing means on said column to detect a tendency of the column to tip from its substantially vertical orientation as a result of the hoisting of the load on the hoist cable; and means interconnecting the sensing means and the means for horizontal movement of the counterweight assembly, whereby the counterweight assembly is positioned to stabilize and balance the apparatus; wherein:

the truss assembly comprises a pair of side walls, a top wall, and a base track;

the lift assembly and the counterweight assembly each include a hanger arm disposed between the side walls and having roller means engaged on the base track; and wherein:

said base track includes a first track section on one side wall and a second track section on the other side wall, each track section including a recess open at the top thereof; and wherein:

said roller means comprises a pair of rollers respectively riding on said first and second track sections, each roller having a rim traveling in the recess of the corresponding track section so that the rollers are locked in the recesses.

3. A hoist apparatus comprising:

a base;

a substantially vertical column secured to the base, said column having a top section;

an elongated substantially horizontal truss assembly secured to the vertical column at a location between the base and the top section;

a series of cables, each having a column end and a truss end, the column ends being anchored to the top section, and the truss ends being pivotally connected to the truss at spaced locations, said locations being positioned at intervals from first locations adjacent the column to outer locations remote from the column;

a lift assembly horizontally movably mounted on one side of the truss assembly, said assembly including a vertically movable hoist cable and means for raising and lowering the hoist cable;

a counterweight assembly movably mounted on the other side of the truss assembly, said counterweight assembly including a suspended weight and means for horizontal movement along the truss in either direction;

sensing means on said column to detect a tendency of the column to tip from its substantially vertical orientation as a result of the hoisting of the load on the hoist cable;

means interconnecting the sensing means and the means for horizontal movement of the counterweight assembly, whereby the counterweight assembly is positioned to stabilize and balance the apparatus;

a plate rotatably mounted on top of the base;

means securing the column to the plate; and brake means for securing the column in selected position on the base, said brake means comprising: a bracket fixed at its lower end to the base, a first brake pad on the upper end of said bracket for frictionally engaging the top surface of said plate, a rod extending upwardly through the base and having on its upper end a second brake pad for frictionally engaging the bottom surface of said plate at a location opposite the first brake pad, and brake actuator means for moving the rod upward to clamp the plate between the two brake pads, thereby securing the column in a selected position.

* * * * *